United States Patent [19]

MacArthur

[11] 4,049,201

[45] Sept. 20, 1977

[54] MECHANICAL SEPARATION OF SUBSTANCES

[76] Inventor: Glen MacArthur, 1659 Sweetbrier St., Palmdale, Calif. 93550

[21] Appl. No.: 711,546

[22] Filed: Aug. 4, 1976

[51] Int. Cl.[2] ..... B02C 19/12

[52] U.S. Cl. ..... 241/5; 241/81; 241/274; 209/234; 209/414

[58] Field of Search ..... 209/234, 281, 409, 420, 209/244, 245, 282, 274, 254, 414, 267, 397, 44, 483, 300; 241/81, 5, 77, 274

[56] References Cited

U.S. PATENT DOCUMENTS

| | | | |
|---|---|---|---|
| 146,993 | 2/1874 | Drury | 209/234 X |
| 772,377 | 10/1904 | Rowland et al. | 241/274 X |
| 2,091,772 | 8/1937 | Steele | 241/5 |
| 3,941,690 | 3/1976 | Powers et al. | 209/44 X |

FOREIGN PATENT DOCUMENTS

| | | | |
|---|---|---|---|
| 925,041 | 4/1973 | Canada | 209/281 |
| 371,153 | 3/1923 | Germany | 209/414 |

*Primary Examiner*—Frank W. Lutter
*Assistant Examiner*—Ralph J. Hill
*Attorney, Agent, or Firm*—Harold C. Horwitz

[57] ABSTRACT

Apparatus and method for dry, mechanical separation of heavy and light materials dispersed in substances. The apparatus comprises a screened funnel through which the substance is introduced, a cylindrical tube mounted on support means and inclined to the vertical, means to spread the substances, within the cylinder a second screened opening through which heavy material passes and exit means for the light weight, waste material.

2 Claims, 6 Drawing Figures

MECHANICAL SEPARATION OF SUBSTANCES

BACKGROUND OF THE INVENTION

1. Field of the Invention

This invention relates to apparatus and method for dry, mechanical separation of heavy and light materials such as minerals and metal bearing earth.

2. Description of the Prior Art

It is known how to separate material of different grain sizes by screening the material either in dry form or in a liquid. It is also known how to separate material of varying densities by flotation process or centrifical separation. Both separation by screening and separation by flotation have their advantages and disadvantages, and the choice of the suitable apparatus depends on the mixtures in question and their physical and chemical properties.

There are cases however when preliminary separation is desired, such as in prospecting, prior to using a process of screening for a particular metal or mineral. This invention provides a dry, mechanical process which selectively screens heavy materials such as metal and mineral bearing earth from lighter weight, waste material. Another object of this invention is to provide a light weight, portable apparatus to separate mineral and metal bearing earth from lighter weight material.

BRIEF SUMMARY OF THE INVENTION

In the present invention there is provided an apparatus for separating heavy and light material dispersed in substances such as the earth, which apparatus comprises a screened funnel through which the material to be separated is introduced, a cylindrical tube mounted on support means and inclined to the vertical, means to spread the material within the cylinder in a laminar flow, fractionalizing means, a second screened opening through which heavy material of a predetermined diameter will pass and exit means for the lighter weight, waste material.

DETAILED DESCRIPTION OF INVENTION

Figure 1:
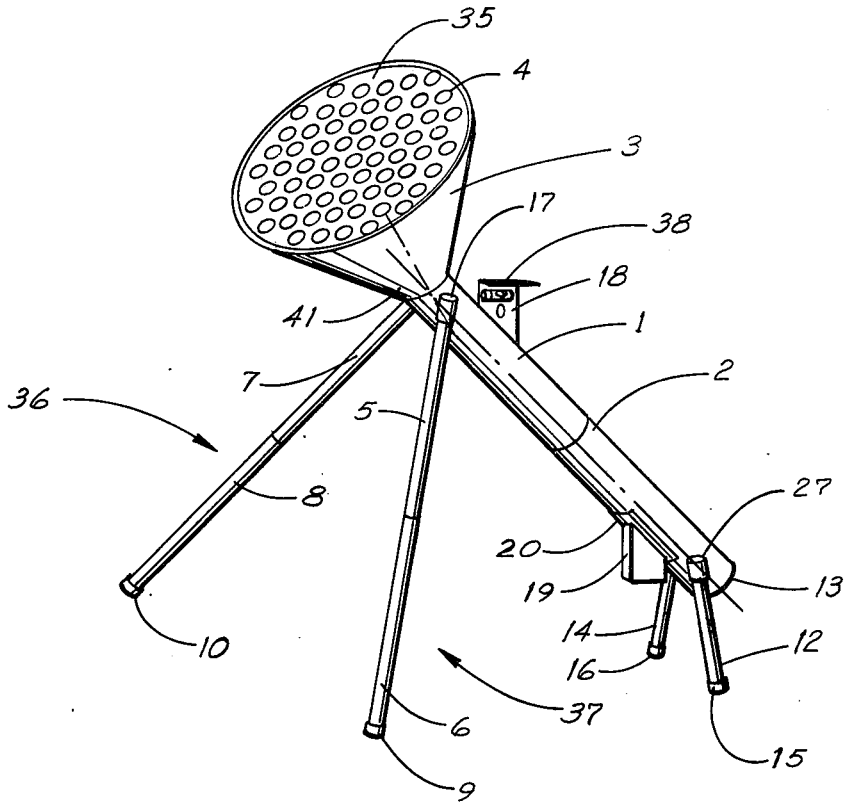
FIG. 1 is a perspective view of the apparatus of the invention.
Figure 2:
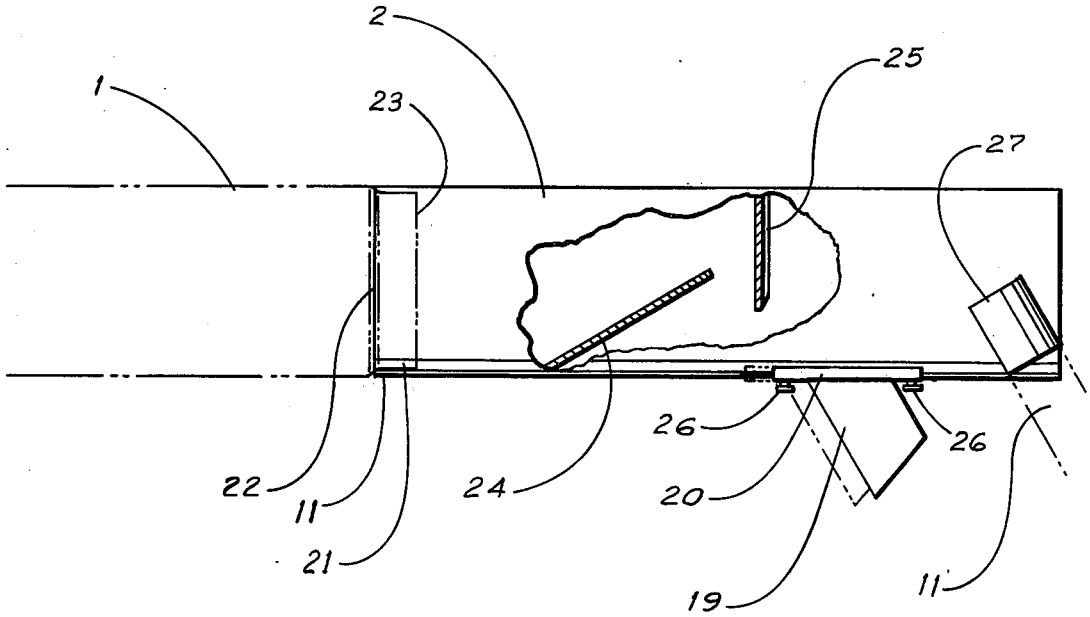
FIG. 2 is a cutaway view of the interior of the cylindrical tube.
Figure 6:
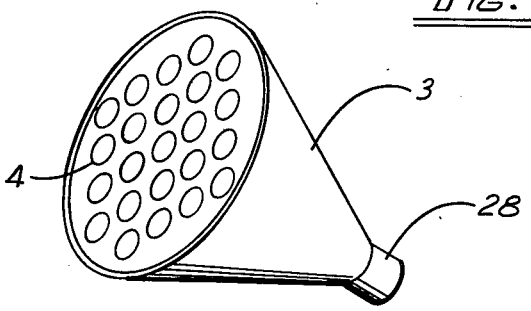
FIG. 6 is a perspective view of the screened, asymmetric, cone-shaped funnel.

Referring to the drawings, FIG. 1, the apparatus comprises a funnel 3 through which the material to be separated passes after its initial screening through screen 35. Diameter of hole 4 is $\frac{3}{8}$ inch although different hole diameters may be used depending upon the type of material to be separated. Material larger than the diameter of hole 4 will not be accepted by the apparatus and will fall to the ground. Funnel 3 terminates in neck member 28, FIG. 6 of diameter slightly less than the diameter of first opening 41 of cylinder 1, providing a tight, friction fit between said members. Cylinder 1 second opening 23, FIG. 2, is of diameter slightly less than diameter of cylinder 2 first opening 22 providing a tight, friction fit between surface 21 of cylinder 1 and surface 11 of cylinder 2. Second opening 13 of cylinder 2 is above ground level by distance $h$ cosine $\theta$ where $\theta$ is angular displacement of support members 12 and 14 from the vertical and $h$ equals length of support members 12 and 14. Support members 12 and 14 are connected to cylinder 2 by frictional insertion into support holders 27.

Figure 5:
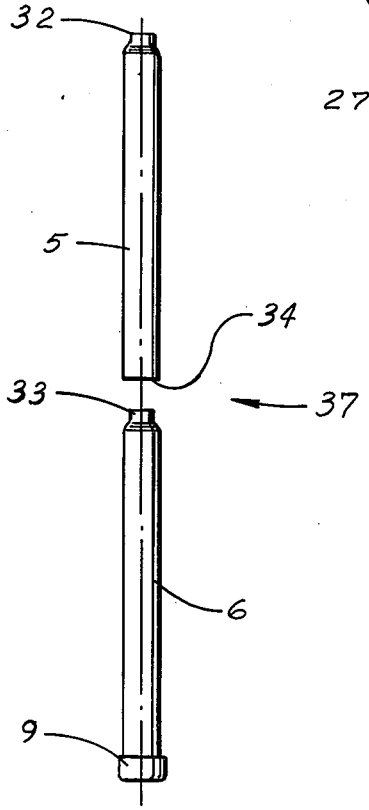
FIG. 5 is a view of a disassembled leg.

Support members 36 and 37 support cylinder 1 and are friction connected to cylinder 1 by inserting said members into support holders 17. Support member 37, FIG. 5, is formed by frictional insertion of neck 33 of member 6 into neck 34 of member 5. Support member 36 is formed by frictional insertion of member 8 into member 7. Support members 12, 14, 36 and 37 terminate in support pads 15, 16, 10 and 9, respectively.

A lever indicator 18 is connected to cylinder 1 in any conventional manner. The plane formed by support pads 9, 10, 15 and 16 is adjusted until the level indicator indicates plane 38 is parallel to the plane formed by support pads 9, 10, 15 and 16. When level indicator 18 indicates a parallel plane condition has been achieved, angle subtended by cylinder 2 to the horizontal plane is in the range of 40° to 60° in the preferred embodiment of this invention, although different angular displacements will be required for the separation of different types of material.

Figure 3:
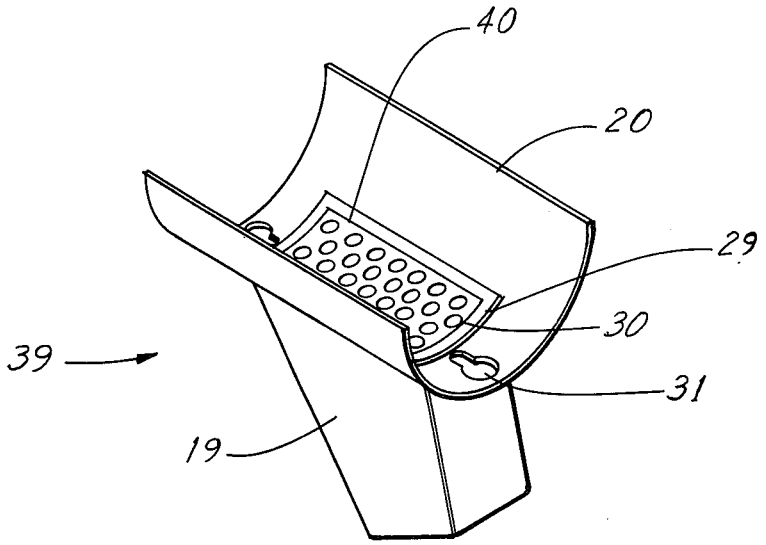
FIG. 3 is a detailed view, in perspective, of the heavy material, screened, outlet chute.

Chute 19, FIG. 3, is connected to cylindrical section 20 in any conventional manner, such as by welding and chute assembly 39 is engaged to cylinder 2 by inserting chute pins 26, FIG. 2, through keyholes 31 in cylindrical section 20. Screen 29, FIG. 3, is placed over chute opening, shown by dotted lines at 40, prior to engagement of chute assembly 39 with cylinder 2. Holes 30 of screen 29 are approximately $\frac{1}{8}$ inch diameter in the preferred embodiment of this invention although different mesh screen will be required for the separation of different weight materials.

After unit has been assembled as discussed above, material to be separated is placed through screened funnel 3. The axis of cylinders 1 and 2 is inclined to the vertical so that material will be accelerated downwardly by the force of gravity and attain a particular speed by the time it reaches plate 24, FIG. 2. Plate 24 serves the purpose of spreading the material into a laminar flow. After the material has been forced into a laminar flow, it strikes plate 25 which breaks the material into smaller pieces and decelerates the rate of material flow.

Accelerated by the force of gravity, the material slides over screen 29. The heavier particles, traveling slower than the lighter particles, fall through opening 30 of screen 29 except for those heavier particles that have a diameter greater than hole 30 diameter. Such heavy particles, along with lighter particles, are discharged through second opening 13 of cylinder 2, as "waste" product. Other heavy particles not accepted by screen 29 are those whose velocity carry them beyond the screen openings 30. Heavy particles are collected in collecting means, not shown, placed beneath chute 19. Angular displacement of cylinders 1 and 2 imparts a particular velocity to particles such that heavy materials, such as silver, gold and other metals, will travel at a lower rate of speed over the screened area and will fall through the holes allowing the lighter materials to be discharged at the second opening of cylinder 2. The vertical component of gravitational force acting upon the material can be varied by adjusting the angular displacement of cylinders 1 and 2 to the vertical axis. An increase in the gravitational force will result in capture of heavier particles through the screen 29; since heavier particles will be traveling slower there is a greater probability of their capture through the screen.

Chute opening 40 in this particular embodiment of the invention is $\frac{7}{8}$ inches wide by $5\frac{1}{2}$ inches long, but the dimensions can be varied to permit a different range of material weights to be screened through the chute.

Figure 4:
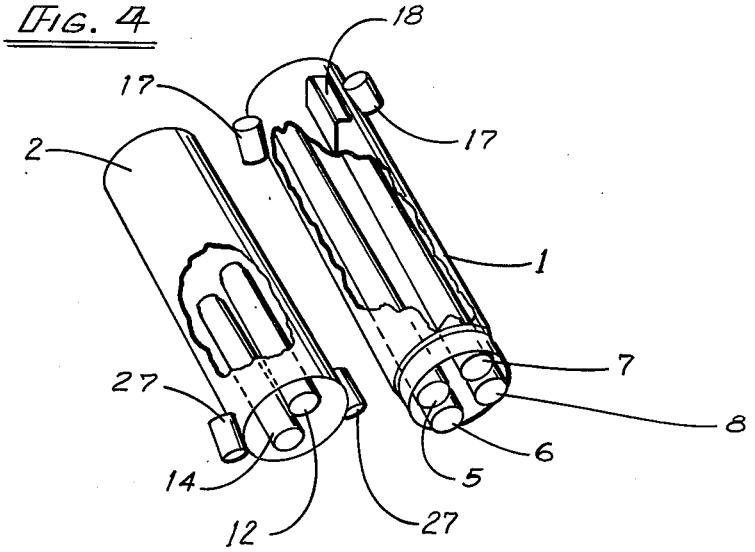
FIG. 4 is a cutaway view of the cylindrical tubes with legs stowed therein.

Apparatus portability is enhanced by providing stowage for support member 5, 6, 7 and 8 in cylinder 1, FIG. 4. Support members 12 and 14 can be stowed in cylinder 2. Hence cylinders 1 and 2 and funnel 3 can be back packed to remote areas and they can be easily and rapidly assembled. The apparatus is suited for operations in any remote area since neither water, chemicals or power are required for operation.

I claim:

1. A device for dry separation of solid particles of different weights when acted upon by the force of gravity, said device comprising a receiving chamber provided with a screen for limiting size of particles introduced into said chamber, a cylindrical passageway to receive particles from said chamber, said cylinder having a spreader plate positioned to impart a laminar flow to the particles, a strike plate to check speed of the particles and break particles into smaller sizes, a screened opening to receive particles of greater weight and an outlet for discharging lighter weight particles.

2. In a process of dry separation of solid particles of different weights when acted upon by the force of gravity, the steps of screening the particles to a predetermined size, accelerating the particles by gravitation force laminarizing the flow of the particles, checking the speed of the particles and breaking the particles into smaller sizes, screening the particles at a first discharge opening and discharge discharging waste particles at a second discharge opening.

* * * * *